US005208075A

United States Patent [19]

Kroner et al.

[11] Patent Number: 5,208,075

[45] Date of Patent: May 4, 1993

[54] SIZING AGENT FOR STAPLE FIBER AND FILAMENT YARNS

[75] Inventors: Matthias Kroner, Bad Durkheim; Manfred Niessner, Schifferstadt; Heinrich Hartmann, Limburgerhof; Dieter Voelker, Mutterstadt; Juergen Hartmann, Ludwigshafen; Holger Schoepke, Neckargemuend, all of Fed. Rep. of Germany

[73] Assignee: BASF Aktiengesellschaft, Ludwigshafen, Fed. Rep. of Germany

[21] Appl. No.: 888,139

[22] Filed: May 26, 1992

Related U.S. Application Data

[62] Division of Ser. No. 746,988, Aug. 19, 1991.

[30] Foreign Application Priority Data

Sep. 15, 1990 [DE] Fed. Rep. of Germany ..... 4029348

[51] Int. Cl.[5] ..... B05D 3/00; C08L 89/00; C08H 1/00

[52] U.S. Cl. ..... 427/389.9; 524/17; 524/25; 524/26; 524/704; 527/201

[58] Field of Search ..... 524/17, 25, 26, 704; 527/201; 427/389.9; 428/365, 394

[56] References Cited

U.S. PATENT DOCUMENTS

| | | | |
|---|---|---|---|
| 2,956,884 | 10/1960 | Caldwell | 527/201 |
| 3,104,154 | 9/1963 | Morimoto et al. | 527/201 |
| 3,546,008 | 12/1970 | Shields et al. | 117/138.8 |
| 3,548,026 | 12/1970 | Weisfeld et al. | 260/83.5 |
| 3,578,492 | 5/1971 | Bollinger | 117/139.5 |
| 4,263,337 | 4/1981 | Login | 427/389.9 |
| 4,268,645 | 5/1981 | Lark | 525/437 |
| 4,542,184 | 9/1985 | Eck et al. | 524/704 |
| 4,812,550 | 3/1989 | Erickson et al. | 117/139.5 |

FOREIGN PATENT DOCUMENTS

| | | | |
|---|---|---|---|
| 1594905 | 11/1973 | Fed. Rep. of Germany | 117/139.5 |

OTHER PUBLICATIONS

Derwent Accession No. 89-059 420 Questel Telesystems (WPIL) Derwent Publications Ltd., London *Zusammenfassung*.

Derwent Accession No. 89-212 301, Questel tele-systems (WPIL) Derwent Publications Ltd., London *Zusammenfassung*.

*Primary Examiner*—Paul R. Michl
*Assistant Examiner*—LaVonda R. DeWitt
*Attorney, Agent, or Firm*—Oblon, Spivak, McClelland, Maier & Neustadt

[57] ABSTRACT

Water-soluble or water-dispersible grafts of proteins with monoethylenically unsaturated monomers are used as sizing agents for staple fiber and filament yarns.

3 Claims, No Drawings

SIZING AGENT FOR STAPLE FIBER AND FILAMENT YARNS

This is a division of application Ser. No. 07/746,988, filed on Aug. 19, 1991 pending.

The present invention relates to the use of water-soluble or water-dispersible grafted proteins obtainable by free radical polymerization of monoethylenically unsaturated monomers in the presence of proteins as sizing agents for staple fiber and filament yarns.

In the textile industry it is in general customary to treat staple fiber and filament yarns with aqueous liquors of natural or synthetic products prior to processing on the weaving machine. This yarn pretreatment, or sizing, serves to increase the mechanical durability of the yarns in order that they may be better equipped to withstand the high stresses of weaving than in the raw, untreated state. The sizing agents used are in particular natural products, such as starch or starch derivatives, but also synthetic polymers, such as polyvinyl alcohol or polyacrylates. Proteins have also been used, for example for filament viscose, filament acetate, and wool. However, even for these purposes protein sizes have frequently been replaced by synthetic polymers, carboxymethylcellulose and starch derivatives. Sizes based on animal proteins, such as casein or bone or skin glue, need to be admixed with softening additives such as glycerol, castor oil and soaps thereof or with surfactants in order to be usable at all as sizing agents. For instance, a blend of casein with paraffins is used as a size emulsion for nylon filaments.

DE-B-15 94 905 discloses the use of water-soluble sodium or ammonium salts of copolymers of acrylonitrile and acrylic acid for sizing staple fiber yarns. According to DE-C-29 26 230, water-soluble alkaline earth metal salts of copolymers of (methy)acrylic acid and (meth)-acrylonitrile are used in mixtures with starch or starch derivatives as sizing agents.

Other synthetic sizing agents are for example polyester sizes as described in U.S. Pat. Nos. 3,546,008, 3,548,026 and 4,268,645.

U. S. Pat. No. 4,812,550 discloses a process for preparing grafted proteins wherein ethylenically unsaturated monomers having not more than 14 carbon atoms in the molecule are subjected to a free radical polymerization in an aqueous medium in the presence of solubilized proteins. The lattices thus obtainable are used as binders for pigmented paper coating compositions. Furthermore, U.S. Pat. No. 3,651,210 discloses that specific emulsion copolymers can be reacted with solubilized proteins and the thus modified proteins used as coating agents for preparing leatherlike coatings or films. The coatings and films thus obtainable are biodegradable.

After weaving, the sized warp yarns are desized and the size residues pass into the waste water, which they will pollute unless biodegradable or bioeliminable.

It is an object of the present invention to provide sizing agents which are substantially biodegradable in or bioeliminable from the waste water and which have improved application properties compared with existing natural sizing agents.

We have found that this object is achieved by using water-soluble or water-dispersible grafted proteins which are obtainable by free radical polymerization of (a) monoethylenically unsaturated monomers in the presence of (b) proteins in a weight ratio of (a):(b) of (0.5–90):(99.5–10) as sizing agents for staple fiber and filament yarns.

Monoethylenically unsaturated monomers of group (a) for preparing the grafted proteins are for example monoethylenically unsaturated $C_3$–$C_8$-carboxylic acids, e.g. acrylic acid, methacrylic acid, ethacrylic acid, crotonic acid, maleic acid, fumaric acid, itaconic acid, aconitic acid and vinylacetic acid. It is also possible to use, if industrially available, the corresponding anhydrides, e.g. maleic anhydride or itaconic anhydride. Of the aforementioned compounds, preference is given to acrylic acid, methacrylic acid and mixtures thereof. The carboxylic acids can be used in the graft copolymerization as free carboxylic acids or in the form of salts with inorganic or organic bases. To neutralize the monoethylenically unsaturated carboxylic acids it is possible to use for example sodium hydroxide, potassium hydroxide, alkaline earth metal oxides and hydroxides, ammonia, trimethylamine, triethylamine, tributylamine, triethanolamine, diethanolamine, morpholine, methylamine or dimethylamine. For neutralization purposes it is also possible to use mixtures of various bases, for example sodium hydroxide and ethanolamine.

Suitable compounds of group (a) also include the esters of the abovementioned carboxylic acids with monohydric or polyhydric $C_1$–$C_{22}$-alcohols. Suitable alcohols for esterifying the above-described monoethylenically unsaturated carboxylic acids are for example methanol, ethanol, n-propanol, isopropanol, n-butanol, isobutanol, tert-butanol, 2-ethylhexyl alcohol, stearyl alcohol, palmityl alcohol, decyl alcohol, dodecyl alcohol, tallow fat alcohol, sorbitol, mannitol, glycerol, ethylene glycol, propylene glycol and butanediol. Preference is given to using the esters of acrylic acid and methacrylic acid with methanol, ethanol, n-propanol, n-butanol, tert-butanol, 2-ethylhexyl alcohol, stearyl alcohol, ethylene glycol and propylene glycol. Of the esters mentioned, particular preference is given to n-butyl acrylate, methyl methacrylate, ethylhexyl acrylate and ethyl acrylate mixed with acrylic acid and methacrylic acid for the graft copolymerization in the presence of proteins.

Other suitable monomers of group (a) are the amides of $C_3$–$C_8$-carboxylic acids which are derived from ammonia, $C_1$–$C_{22}$-alkylamines or dialkylamines. Suitable amines for preparing the amides are for example methylamine, dimethylamine, stearylamine, tallow fat amine and palmitylamine. It is also possible to use the N-methylol derivatives of amides, for example N-methylolacrylamide or N-methylolmethacrylamide. The aforementioned N-methylol derivatives of the amides may also be etherified, for example with $C_1$–$C_{22}$-alcohols, preferred monomers being N-(butoxymethyl-)acrylamide and N-(isobutoxymethyl)acrylamide.

Other suitable monomers (a) are the nitriles of carboxylic acids, such as acrylonitrile or methacrylonitrile, vinyl ethers of alcohols containing from 1 to 18 carbon atoms, e.g. vinyl methyl ether, vinyl isobutyl ether, vinyl n-butyl ether and vinyl ether ether, and also vinyl esters of saturated $C_1$–$C_4$-carboxylic acids, in particular vinyl acetate, vinyl propionate and vinyl butyrate. Other suitable monomers are styrene and alkylstyrenes. The graft copolymers contain the monomers (a) in copolymerized form in amounts of from 0.5 to 90, preferably from 10 to 85, % by weight.

The other essential component of graft copolymerization is a protein (b). For this purpose it is possible to use any protein which, under the conditions of the polymerization, is soluble in the polymerization medium in a proportion of at least 20% by weight. Suitable proteins are described for example in above-cited U.S. Pat. No. 4,812,550. A further survey of suitable proteins may be found in Ullmanns Enzyklopädie der technischen Chemie, 4th Edition, Weinheim 1980, Volume 19, 491–557. The proteins in question are sustainable raw materials. They are derived for example from skin, hides, supportive and connective tissue, bones and cartilage: collagen, elastin, gelatin, ossein and glue. Proteins from milk are whey proteins, casein and lactalbumin. Wool, bristles, feathers and hairs are the source of keratin. It is also possible to use proteins from fish and eggs and from blood as slaughterhouse waste, for example blood proteins, albumen, globulin, globin, fibrinogen and hemoglobin. Other suitable proteins come from plants, such as corn, wheat, barley and oats: glutelin, prolamin, zein and gluten. It is also possible to obtain proteins from seeds, for example from soybeans, cotton seeds, peanuts, sunflower seeds, rapeseed, coconut, linseed, sesame, safflower, peas, beans and lentils. It is also possible to use the protein constituents of clover, lucerne, grass, potatoes, manioc and yam. Further protein sources are bacteria, fungi, algae and yeasts, e.g. Pseudomonas, Lactobacillus, Penicillium, blue algae, green algae, Chlorella, Spirulina and exhausted yeast. The proteins which are preferred for use as component (b) for preparing the graft copolymers are casein, gelatin, bone glue and proteins from soybeans, cereals, in particular wheat, corn and peas. The proteins are for example isolated from the natural raw materials by dissolving, grinding, sifting and classifying. To convert them into a soluble form, they need in many cases to be subjected to a digestive process in the form of a physical, chemical or enzymatic treatment, for example hydrolysis with acid or alkali, fermentation with yeasts, bacteria or enzymes, extraction methods for removing concomitants, coagulation from extracts by heat, addition of electrolyte, pH change or addition of coagulating agents. To obtain pure products, a possible option is for example fractional dissolving and precipitating and a dialysis process.

In the copolymerization, the monoethylenically unsaturated monomers (a) are used with the proteins (b) in a weight ratio of (a):(b) of (0.5–90):(99.5–10), preferably (10–85):(90–15).

The monomers (a) are polymerized in the presence of proteins by a free radical mechanism. The free radical donor can be any compound known for this purpose. This initiator may be soluble or else insoluble in water. Water-soluble initiators are for example inorganic peroxides, such as potassium peroxodisulfate, sodium peroxodisulfate, ammonium peroxodisulfate and hydrogen peroxide. It is also possible to use organic peroxides, hydroperoxides, peracids, ketone peroxides, perketals and peresters, e.g. methyl ethyl ketone hydroperoxide, cumene hydroperoxide, tert-butyl hydroperoxide, 1,1-di(tert-butylperoxy)cyclohexane, di(tert-butyl) peroxide, tert-butyl peroxypivalate, tert-butyl monoperoxymaleate, dicyclohexyl peroxydicarbonate, dibenzoyl peroxide, diacetyl peroxide, didecanoyl peroxide and mixtures thereof. It is also possible to use redox systems which combine a peroxy compound with a reducing component. Suitable reducing components are for example cerium(III) and iron(II) salts, sodium sulfite, sodium hydrogen sulfite, sodium dithionite, ascorbic acid and sodium formaldehydesulfoxylate. The initiator chosen is preferably a compound which forms free radicals and has a halflife of less than 3 hours at the particular chosen polymerization temperature. If the polymerization is started at a low temperature and completed at a higher temperature, it is advantageous to use at least two initiators which decompose at different temperatures, namely an initiator which decomposes at a low temperature for the start of the polymerization and an initiator which decomposes at the high temperature for the completion of the main part of the polymerization. By adding heavy metal salts, for example copper, cobalt, manganese, iron, nickel and chromium salts, to peroxidic catalysts it is possible to reduce the decomposition temperature of the latter. Suitable initiators also include azo compounds, such as 2,2'-azobisisobutyronitrile, 2,2'-azobis(2-amidinopropane) dihydrochloride, 2,2,'-azobis(2-methylpropionamidine) dihydrochloride, 2,2,'-azobis(2,4-dimethylvaleronitrile) and dimethyl 2,2,'-azobisisobutyrate. Particular preference is given to using hydrogen peroxide, potassium peroxodisulfate, ammonium peroxodisulfate and sodium peroxodisulfate and tert-butyl perpivalate as initiator in the graft polymerization. Based on the monomers to be polymerized, the amount of initiator or initiator mixture used is from 0.5 to 10, preferably from 1 to 8, % by weight. The amount of initiator used can have an appreciable influence on the graft polymer which is formed.

If water-insoluble monomers are used in the graft polymerization, it is possible to obtain polymers having particularly advantageous properties by first adding a water-soluble initiator for the main reaction and then a water-insoluble initiator for completing the polymerization and removing remaining monomers from the latex. However, it can also be advantageous to introduce a fraction of the total amount of initiator required at the start of the polymerization and to add the remainder continuously or batchwise over a period of from 10 minutes to 10 hours, preferably from 1 to 3 hours. This is particularly advantageous in the case of monomers which are slow to polymerize and for reducing the residual monomer content of the graft polymer. If the monomers and the initiator are metered simultaneously into a polymerizing mixture, it is advantageous to add the initiator over a period which is from 10 minutes to 2 hours longer than the period over which the monomers are added. For instance, the time for adding the monomers may be 2 hours and for the initiator 3 hours.

The graft polymerization may, if desired, be carried out in the presence of regulators. Suitable regulators are for example mercapto compounds, such as mercaptoethanol, mercaptopropanol, mercaptobutanol, mercaptoacetic acid, mercaptopropionic acid, butylmercaptan and dodecylmercaptan. Suitable regulators also include allyl compounds, such as allyl alcohol, aldehydes such as formaldehyde, acetaldehyde, propionaldehyde, n-butyraldehyde and isobutyraldehyde, formic acid, ammonium formate, propionic acid, hydroxylamine sulfate and butenols. If the graft polymerization is carried out in the presence of regulators, they may be used in amounts of from 0.05 to 20% by weight, based on the monomers used in the polymerization.

The polymerization can be carried out in an aqueous medium or in an organic solvent in which the proteins are soluble to at least 20% by weight. Suitable organic solvents are for example acetic acid, formic acid, alcohols, such as methanol, n-propanol, isopropanol, n-butanol, tert-butanol and isobutanol, and ethers, such as tetrahydrofuran and dioxane. It is also possible to use ketones, such as acetone and methyl ethyl ketone, as inert diluents in the graft polymerization. Particular preference is given to the use of methanol, ethanol, isopropanol, acetone, tetrahydrofuran and dioxane. The graft polymerization can be carried out in mixtures of organic solvents and also in mixtures of water and organic solvents which are soluble in water. The concentration of monomer and protein in the particular solvent used is from 10 to 70, preferably from 15 to 60, % by weight.

The graft polymerization is carried out in customary apparatus equipped with mixing elements, for example in stirred flasks, kettles, autoclaves and cylindrical reactors. The graft polymerization may also be carried out in kettle cascades or in other interconnected polymerization apparatus. The polymerization may be carried out batchwise or continuously. Suitable polymerization apparatus also includes kneaders. If water-soluble monomers (a) are used in the graft polymerization, the polymerization may also be carried out as a reverse suspension polymerization or as a water-in-oil emulsion polymerization. Preferably, the graft polymerization takes the form of a solution polymerization or emulsion polymerization. If it is carried out as an emulsion polymerization, it is also possible to add the emulsifiers and protective colloids in amounts of up to 5% by weight. Preferably, however, no surface-active additives are present. For specific applications it may be useful to employ a precipitation polymerization. The polymerization need not be initiated solely with free radical initiators, but may also be initiated by the action of UV radiation or by the action of high-energy rays, for example $\alpha$- or $\beta$- or $\gamma$-rays. The graft polymerization is carried out within the temperature range from 20° to 160° C., preferably from 30° to 100° C. In the case of temperatures which are above the boiling point of the particular solvent used, the graft polymerization is customarily carried out in pressure-tight apparatus. The polymerization is preferably carried out in an inert gas atmosphere in the absence of atmospheric oxygen, for example by using nitrogen, argon, helium or carbon dioxide as inert gas. The reaction temperature and the amount of initiator have an effect on the properties of the graft polymers formed.

In the case of relatively small polymerization batches, where the heat of polymerization can be removed sufficiently rapidly, the monomers to be polymerized and the protein can be introduced into the reaction vessel at the start together with at least one polymerization initiator and polymerized by heating to the particular polymerization temperature required. It is more advantageous, however, to charge the polymerization apparatus with only a portion of the monomer (a) and a portion of the initiator as well as all of the protein (b) and to add the remaining monomer (a) and initiator continuously or batchwise at a rate commensurate with the rate of polymerization. The order in which the reactants are metered into the polymerization reactor can be freely varied. For instance, it is possible to heat a solution or dispersion of the protein in the reactor to the required polymerization temperature and to add the monomers and initiators continuously or batchwise. If a plurality of monomers are used in the graft polymerization, the individual monomers can be metered into the polymerization zone in succession, or as a mixture or else simultaneously from separate metering means. In the case of relatively large polymerization batches and preferably in the case of water-insoluble monomers (a) it can be advantageous to prepare a mixture of water, solvents, regulators, bases and the total amounts of monomers (a) and proteins (b) and to meter this mixture in the polymerization vessel continuously or batchwise, simultaneously with the initiator, at a rate commensurate with the rate of polymerization. However, these variations can have considerable effects on the effectiveness of the graft polymers when used as sizing agents.

Similarly, the pH of the reaction medium can have an influence on the properties of the graft polymer. The solubility of the proteins below and above the iso-electric point can be utilized in the graft polymerization. Acidic or basic monomers can be used in the form of the corresponding salts. For instance, acrylic acid is employed in the form of a free acid or in the form of the ammonium or an alkali or alkaline earth metal salt. The graft polymerization can be carried out within the pH range from 1 to 14, preferably from 6 to 12. By changing the pH it is possible for example to precipitate the graft polymers from solutions. This possibility may be employed when working up, purifying and isolating the graft copolymers. It can be of advantage to use two or more proteins in the graft polymerization. The order in which these proteins are used can have favorable effects on the properties of the graft copolymers formed. In some cases it is of advantage to utilize the emulsifying power of protein by first emulsifying a water-insoluble monomer with a protein and then adding a further protein and subjecting the reaction mixture to the graft copolymerization. In the case of water-insoluble monomers, for example n-butyl acrylate, N-butoxymethylacrylamide, N-isobutoxymethylmethacrylamide, 2-ethylhexyl acrylate or methyl methacrylate, it is possible, in a preferred embodiment, first to prepare a three-phase mixture of monomer, water and insoluble protein, e.g. casein. Then the protein is dissolved by adding an alkali, for example sodium hydroxide solution, potassium hydroxide solution, ammonia solution, triethylamine, alkanolamine, morpholine or some other alkaline substance. The emulsifying effect of the protein being dissolved is particularly good with this method.

If ammonia, triethylamine or other volatile bases are used as neutralization bases for the protein, the films obtained from the graft polymerization can be converted, by heating to 50° to 150° C., particularly effectively under reduced pressure, into a form which is redispersible in water only if the pH is above 7. In pure water, the graft polymer films thus prepared and treated are only slightly swellable or insoluble. However, when a base is added, spontaneous redispersion takes place. This can be utilized by providing the yarns with a water-impervious protective film which is readily removable in a specific manner only in an alkaline medium. For example, a casein which has been grafted with n-butyl acrylate, neutralized with ammonia solution and then, by removal of the solvent under reduced pressure, isolated in film form and dried in a drying cabinet at 80° C. for 10 minutes is just redispersible in water, whereas the film is water-insoluble if it has been stored at 80° C. for 1 hour. The film can then be stored under water for at least 1 week without losing its shape. On addition of a few drops of sodium hydroxide solution it forms a finely divided emulsion which is indistinguishable from the original emulsion.

The proteins used in the graft copolymerization may be chemically modified in various ways before or after the graft polymerization. For example, it can be of advantage to partially degrade the protein before the polymerization by hydrolytic or enzymatic means. Depending on the reaction conditions, a partial hydrolytic degradation of the proteins may take place during the graft polymerization. After the graft polymerization the graft polymers may be modified in various ways, for example graft polymers of alkyl acrylates on proteins may be hydrolyzed with elimination of an alcohol.

Similarly, before or after the free radical grafting, functional groups of the proteins can be reacted with reactive carboxylic acid derivatives, for example carboxylic anhydrides. Examples of carboxylic anhydrides are acetic anhydride, succinic anhydride and maleic anhydride.

The grafted proteins thus obtainable with monoethylenically unsaturated monomers either in dissolved or dispersed form have K values of from 10 to 200, preferably from 15 to 180 (determined by the method of H. Fikentscher in 1% strength in water at 25° C. and pH 7). In the closed bottle test the graft copolymers show a degree of biodegradability which corresponds to the protein content, and in the Zahn-Wellens elimination test they are very readily eliminable. If they are to be stored in the presence of water, a commercial preservative is used. In the air-dried state, the graft polymers have long storage lives even without preservatives.

The graft polymers described are used as sizing agents for staple fiber and filament yarns. These yarns are made of cellulose fiber materials, for example cotton, staple viscose, linen, jute and ramie; and polyester/cellulose fiber blends, polyester, polyacrylonitrile, filament viscose, wool, polyester/wool blends, acetate, triacetate and polyamide. The level of sizing agent on the yarns is customarily from 0.5 to 30% by weight, based on the yarns. The graft polymers can be used not only alone but also together with other components. Moreover, they can be mixed with one another in any desired proportion to achieve specific properties. For example, a relatively soft graft polymer of 60% of ethylhexyl acrylate and 40% of casein in the form of an aqueous emulsion can be mixed in any desired ratio with an aqueous emulsion of relatively brittle graft polymer of 60% of methyl methacrylate and 40% of casein. The mixing ratio between the hard and the soft components makes it possible to adjust the hardness of the resulting films of these mixtures to desired values. In this way it is possible to obtain specific film properties by the specific mixing of two or more graft copolymers.

The graft polymers to be used according to the present invention are noteworthy for their good sizing effect and their high film hardness hence their low tendency for sticking the sized warp threads together. Furthermore, they exhibit high adhesive strength levels and stability to mixing and storage, and they do not gel under processing conditions. They are also notable for their ease of washing off prior to the further processing of the fabrics produced using the sizing agents. A particular advantage is the environmentally safe disposal of the graft polymer residues in the waste water following washoff, since the natural portions of the graft polymers are biodegradable and the synthetic portions are readily eliminable.

For instance, in the Zahn-Wellens test a graft polymer of 40% casein and 60% n-butyl acrylate is 93% eliminated from the aqueous supernatant of the test solution within 2 days.

The K values were determined by the method of H. Fikentscher, Cellulosechemie, 13 (1932), 58–64, 71–74; $K=k\times10^3$. The measurements were carried out on 1% strength by weight aqueous solutions of the graft polymers at 25° C. and pH at 7. The %ages are by weight. The preservative used for the aqueous solutions and dispersions of the graft polymers was Proxel XL 2 in the form of a 10% strength aqueous solution.

EXAMPLES

Preparation of graft polymers

Graft polymer 1

A 2 l capacity glass apparatus equipped with a horseshoe stirrer, feed means for monomers, initiator solutions and sodium hydroxide solution, a reflux condenser and nitrogen inlet and outlet is charged with a solution of 150 g of bone glue in 100 g of water, which is heated to 80° C. under nitrogen. 30 g of solid casein in 22 g of 5% strength aqueous sodium hydroxide solution are then added. The result is a viscous, homogeneous solution to which 120 g of n-butyl acrylate and 100 g of 4% strength aqueous sodium peroxodisulfate solution are added dropwise, starting at the same time, from two feed vessels in the course of 2 and 3 hours respectively. After the initiator has been added, the reaction mixture is stirred at 80° C. for 3 hours and then diluted with 300 g of water. Thereafter 1 g of the customary preservative for casein is added, and the reaction mixture is filtered. This leaves a milky emulsion having a solids content of 32%. The K value of the graft polymer is 16.6. The graft polymer contains 0.12% of unconverted n-butyl acrylate.

Graft polymer 2

In the above-described apparatus, 225 g of bone glue are dissolved in 160 g of water by heating to 80° C. under nitrogen. Then 15 g of n-butyl acrylate and 30 g of a 3% strength sodium peroxodisulfate solution are added separately but simultaneously in the course of 10 minutes and 15 minutes respectively. After a further 15 minutes, 275 g of a 27% strength aqueous acrylic acid solution and 100 g of 4% strength aqueous sodium peroxodisulfate solution are added dropwise separately but simultaneously in the course of 2 hours and 2.5 hours respectively. After the initiator has been added, the reaction mixture is stirred at 80° C. for 3 hours and then neutralized with 170 g of 25% strength aqueous sodium hydroxide solution and admixed with 1 g of a commercial preservative. 370 g of water are added to obtain a cloudy solution having a solids content of 32%. The K value of the graft polymer is 86 and the residual monomer content is 0.005%.

Graft polymer 3

In the apparatus described for the preparation of graft polymer 1, 120 g of casein (in the acid form) are suspended in 500 g of water under nitrogen at 20° C. Then 180 g of n-butyl acrylate are added all at once and the mixture is stirred at 20° C. for 15 minutes. Then 32 g of a 12.5% strength aqueous sodium hydroxide solution are added dropwise in the course of 15 minutes. On completion of the sodium hydroxide addition the mixture is stirred at 20° C. for 40 minutes. Then 100 g of a 3% strength aqueous potassium peroxodisulfate solution are added all at once and the temperature of the reaction mixture is raised to 75° C. As soon as that temperature is reached, 70 g of a 3% strength aqueous potassium peroxodisulfate solution are metered in over 2 hours and subsequently the reaction mixture is stirred at 70° C. for 4 hours. Then 1 g of the preservative is added to obtain a white latex having a solids content of 29%. The K value of the graft polymer is 20.8. The polymer has a residual monomer content of 0.03% of n-butyl acrylate.

Graft polymer 4

In the above-described apparatus, 60 g of casein, 500 g of water, 75 g of n-butyl acrylate and 15 g of methyl acrylate are stirred at 20° C. under nitrogen and neutralized with 29 g of a 7% strength aqueous sodium hydroxide solution. The mixture is stirred at 20° C. for a further 30 minutes and then admixed with 100 g of a 3% strength aqueous potassium peroxodisulfate solution. The reaction mixture is heated to 75°-80° C. At that temperature 70 g of a 3% strength aqueous potassium peroxodisulfate solution are added in the course of 2 hours and the rest of the procedure is as described for the preparation of graft polymer 3. The result obtained is an emulsion having a solids content of 17.5%. The graft polymer has a K value of 19.7.

Graft polymers 5 and 6

These graft polymers are prepared by the method described for the preparation of graft polymer 3 from the starting materials indicated in the following table:

TABLE

| Graft polymer | Protein [g] isolated from | Water [g] | n-Butyl acrylate [g] | 12.5% strength sodium hydroxide solution [g] | 3% strength KPS [g] | 3% strength KPS [g] | t-BPP [g] | K value |
|---|---|---|---|---|---|---|---|---|
| 5 | 120 wheat | 550 | 180 | 32 | 100 | 70 | 1 | 18.3 |
| 6 | 120 soybean | 500 | 180 | 40 | 100 | 70 | 1 | 21.5 |

KPS = aqueous potassium peroxodisulfate solution
t-BPP = tert-butyl perpivalate, 75% strength in aliphatics Graft polymer 7

In the apparatus described for the preparation of graft polymer 1, 200 g of bone glue are dissolved in 140 g of water at 80° C. under nitrogen. 260 g of a 23% strength aqueous acrylic acid solution and 100 g of a 4% strength aqueous sodium peroxodisulfate solution are then added separately but simultaneously in the course of 2 hours and 3 hours respectively. After the initiator has been added, the reaction mixture is stirred at 80° C. for 1 hour, cooled and neutralized with 170 g of a 20% strength aqueous sodium hydroxide solution. The polymer solution has a solids content of 31%. The graft polymer has a K value of 79.4.

Graft polymer 8

As in the preparation of graft polymer 3, 120 g of casein are suspended in 500 g of water, but then 30 g of n-butyl acrylate are added. After 8 g of 50% aqueous hydroxide solution have been added and the mixture has been thoroughly emulsified, the polymerization is initiated with 100 g of 3% strength aqueous potassium peroxodisulfate solution and completed by the continuous addition of 60 g of 3% strength potassium peroxodisulfate solution. The residual monomer is substantially removed by addition of 0.5 g of tert-butyl perpivalate. This gives a cloudy 18% strength by weight solution of a graft polymer, which has a K value of 26.2. The remaining amount of n-butyl acrylate is 0.08%.

Graft polymer 9

In the apparatus used for preparing graft polymer 1, 150 g of bone glue and 100 g of water are stirred under nitrogen and heated to 85° C. A solution forms, to which is added separately but simultaneously a mixture of 75 g of acrylic acid and 75 g of n-butyl acrylate on the one hand and 100 g of a 4% strength aqueous sodium peroxodisulfate solution on the other in the course of 2 hours and 3 hours respectively. After the initiator has been added, the reaction mixture is stirred at 80° C. for 2 hours and then neutralized with 170 g of a 25% strength aqueous sodium hydroxide solution. 500 g of water and 1 g of a commercial preservative are added to give a 27% strength latex. The K value of the polymer is 92. The graft polymer contains 0.03% of unconverted n-butyl acrylate.

Graft polymer 10

In the apparatus described for the preparation of graft polymer 1, 120 g of casein are suspended in 400 g of water and admixed with 8 g of 50% strength aqueous sodium hydroxide solution. An aqueous solution forms, to which is added 30 g of acrylic acid in the course of 10 minutes followed dropwise by sufficient 10% strength aqueous sodium hydroxide solution for the precipitate to be dissolved. Then 100 g of a 4% strength aqueous potassium peroxodisulfate solution are added and the reaction mixture is heated to 70° C. under nitrogen. The polymerization time is 3 hours. Then the reaction mixture is diluted. This gives an aqueous polymer solution having a solids content of 18%. The graft polymer has a K value of 28.9.

Graft polymer 11

In the apparatus described for the preparation of graft polymer 1, 120 g of casein are suspended in 450 g of water at 20° C. Then 40 g of methyl methacrylate and a solution of 26 g of acrylic acid and 29 g of 50% strength aqueous sodium hydroxide solution in 50 g of water are each added under nitrogen all at once and the resulting mixture is neutralized with 32 of 12.5% aqueous sodium hydroxide solution added over 10 minutes with intensive stirring. After 100 g of 3% strength aqueous potassium peroxodisulfate solution have been added, the reaction mixture is heated to 75°-80° C. and, once that temperature level has been reached, admixed with 100 g of a 2% strength aqueous potassium peroxodisulfate solution in the course of 2 hours. After the initiator has been added, the reaction mixture is stirred at 80° C. for 4 hours. This gives a latex having a solids content of 19%. The graft polymer has a K value of 37.7 and contains 0.002% of unconverted methyl methacrylate.

Graft polymer 12

In the apparatus used for the preparation of graft polymer 1, 120 g of casein are suspended in 600 g of water at 20° C. and admixed with 80 g of N-(n-butoxymethyl)acrylamide added all at once. After 32 g of 12.5% strength aqueous sodium hydroxide solution have been added, a finely divided emulsion forms after 40 minutes' stirring. The emulsion is admixed with 100 g of a 3% strength potassium peroxodisulfate solution and heated to 80° C., and at that temperature 100 g of a 2% strength aqueous potassium peroxodisulfate solution are added dropwise in the course of 2 hours. After the initiator has been added, the emulsion is stirred at 75° C. for 4 hours, diluted with 300 g of water and admixed with 1 g of the preservative. It has a solids content of 20%. The K value of the graft polymer is 45.6.

Graft polymer 13

Examples 12 is repeated, except for the sole difference that the N-(n-butoxymethyl)acrylamide is replaced by N-(isobutoxymethyl)acrylamide. In this case the K value of the graft polymer is 44.8.

Graft polymer 14

The apparatus described for the preparation of graft polymer 1 is charged with 140 g of water and the water is heated to 85° C. At this temperature 200 g of gelatin are added a little at a time and the mixture is stirred until a clear solution has formed. Then 50 g of a 4% aqueous sodium peroxodisulfate solution and a solution of 60 g of methacrylic acid in 320 g of water are added separately but simultaneously from two metering vessels both in the course of 2 hours and thereafter the reaction mixture is stirred at 85° C. for 2 hours. After cooling, the reaction mixture is neutralized with 56 g of 50% strength aqueous sodium hydroxide solution. The polymer solution has a solids content of 31%. The K value of the graft polymer is 96.

Graft polymer 15 a) Preparation of soft component

In the apparatus described for the preparation of graft polymer 1, 120 g of casein, 500 g of water and 180 g of ethylhexyl acrylate are intimately mixed at 20° C. under nitrogen. After 8 g of 50% strength aqueous sodium hydroxide solution have been added, the casein dissolves, forming a finely divided, smooth emulsion, which is stirred at 20° C. for 40 minutes. Then 25 g of a 13% strength aqueous sodium peroxodisulfate solution are added and the reaction mixture is heated to 75° C. As soon as that temperature is reached, a further 25 g of 13% strength aqueous sodium peroxodisulfate solution are added dropwise in the course of 2 hours. After the initiator has been added, the reaction mixture is stirred at 75° C. for 2 hours, admixed with 1 g of 75% strength tert-butyl perpivalate, which is added all at once, and further stirred at 75° C. for 2 hours. The solids content of the emulsion is adjusted to 25% with water. The graft polymer has a K value of 21.4. The residual level of unconverted ethylhexyl acrylate is 0.1%.

b) Preparation of hard component

The procedure of a) is repeated, except that the ethylhexyl acrylate monomer is replaced by 180 g of methyl methacrylate, affording under identical conditions a latex whose solids content is adjusted to 25%. The graft polymer has a K value of 18.3. The residual level of unconverted methyl methacrylate is 0.012%.

The latices prepared as per a) and b) are mixed in such a way that the resulting mixture contains 70% of the latex of a) and 30% of the latex of b). The mixture is then admixed with 1 g of the preservative. It is stable for weeks.

Application properties of graft polymers

The above-described graft polymers 1 to 15 are used as sizing agents for staple fiber and filament yarns. To assess the application properties of the graft polymers they were rated in terms of A) the film properties and B) the sizing effect, measured in a pilling test and in a pseudo warp yarn breakage test.

A) Determination of film properties by pendulum hardness test

To determine the film properties, the hardness of the films was tested. The test instrument used was the König pendulum tester (German Standard Specification DIN 53 157).

The above-described graft polymers 1 to 15 were made into films 2 mm in thickness. The films were then dried at 80° C. for 3 hours and thereafter maintained at 65% or 80% relative humidity and 20° C. for 24 hours. They are then tested on the pendulum tester in accordance with the method.

B) Determination of sizing effect

The sizing effect is tested on a Reutlingen Institute weave tester, which simulates the stress on warp yarns during weaving by repeatedly subjecting sized yarns under a certain tension to mechanical stresses by means of metal pins (J. Trauter and R. Vialon, Textil Praxis International 1985, 1201). The number of stresses (cycles) at which a certain degree of damage to the yarn is observed is a measure of the quality of the sizing agent.

The criteria for the sizing effect are a) the pilling values (the pilling value is that number of cycles at which the formation of a pill is observed on the sixth yarn) and b) the pseudo warp yarn breakage values (pseudo warp yarn breakage value is that number of cycles at which the sixth yarn slackens).

High pilling and pseudo warp yarn breakage values indicate a good sizing effect.

To determine the sizing effect, cotton yarns were sized at room temperature with 8% strength aqueous liquors of each of the graft polymers indicated hereinafter and 65/35 w/w polyester/cotton yarns with 14% strength aqueous liquors.

To determine the sizing effect of the graft polymers when mixed with starch (hydroxypropyl potato starch), cotton was sized at room temperature with 11% strength aqueous liquors (67% of starch/33% of graft polymer).

The sizing was carried out on the laboratory sizing machine (DE-C-2 714 897). Then the sized yarns were kept at 68% relative humidity and 20° C. for 24 hours.

The Examples show the results of the tests (film properties and sizing effect). The graft polymers 1 to 15 to be used according to the present invention are tough, elastic and homogeneous and give a good sizing effect in terms of pilling and pseudo warp yarn breakage values.

Pendulum hardness of graft polymers
EXAMPLES 1 TO 11

| Example | Sizing agent | Pendulum hardness 65% | Relative humidity 80% |
|---|---|---|---|
| 1 | Graft polymer 1 | 45 | 9 |
| 2 | Graft polymer 9 | 45 | 9 |
| | Bone glue (comparison) | 119 | 8 |

-continued

Pendulum hardness of graft polymers
EXAMPLES 1 TO 11

| Example | Sizing agent | Pendulum hardness 65% | Relative humidity 80% |
|---|---|---|---|
| 3 | Graft polymer 3 | 44 | 13 |
| 4 | Graft polymer 8 | 79 | 30 |
| 5 | Graft polymer 10 | 15 | 7 |
| 6 | Graft polymer 11 | 14 | 8 |
| 7 | Graft polymer 12 | 36 | 12 |
| 8 | Graft polymer 13 | 46 | 17 |
| 9 | Graft polymer 15 | 42 | 11 |
| | Casein (comparison) | 109 | 42 |
| 10 | Graft polymer 5 | 18 | 5 |
| | Gluten (comparison) | * | * |
| 11 | Graft polymer 14 | 25 | 7 |
| | Gelatin (comparison) | 161 | 34 |

*The films were so brittle that they came away from the substrate in the course of drying and it was therefore impossible to measure the pendulum hardness.

It is known from experience that good sizing agents give pendulum hardnesses of from 10 to 80 at 65% relative humidity and from 5 to 30 at 80% relative humidity. By grafting, the brittle and excessively hard proteins with pendulum hardnesses of above 80 or 30 under the respective conditions are modified in such a way that they give films having good application properties.

Sizing effect of graft polymers:
EXAMPLES 12 TO 17
Application properties of graft polymers 1 to 6 on polyester/cotton. The size level on the yarns was 15%.

| | | Sizing effect | |
|---|---|---|---|
| Example | Sizing agent | Pilling | Pseudo warp yarn breakage |
| 12 | Graft polymer 1 | 317 | 1657 |
| 13 | Graft polymer 2 | 280 | 828 |
| | Bone glue (comparison) | <100 | 224 |
| 14 | Graft polymer 3 | 710 | 2481 |
| 15 | Graft polymer 4 | 298 | 1878 |
| | Casein (comparison) | 207 | 303 |
| 16 | Graft polymer 5 | 407 | 1735 |
| | Gluten (comparison) | <100 | 253 |
| 17 | Graft polymer 6 | 1071 | 2148 |
| | Bone glue (comparison) | <100 | 172 |

EXAMPLES 18 TO 21
Application properties of graft polymers 1, 2, 5 and 6 on cotton. The size level on the yarns was 10%.

| | | Sizing effect | |
|---|---|---|---|
| Example | Sizing agent | Pilling | Pseudo warp yarn breakage |
| 18 | Graft polymer 1 | 340 | 1176 |
| 19 | Graft polymer 2 | 465 | 1021 |
| | Bone glue (comparison) | <100 | 412 |

-continued

EXAMPLES 18 TO 21
Application properties of graft polymers 1, 2, 5 and 6 on cotton. The size level on the yarns was 10%.

| | | Sizing effect | |
|---|---|---|---|
| Example | Sizing agent | Pilling | Pseudo warp yarn breakage |
| 20 | Graft polymer 5 | 167 | 493 |
| | Gluten (comparison) | <100 | 167 |
| 21 | Graft polymer 6 | 233 | 570 |
| | Soy protein (comparison) | <100 | 182 |

EXAMPLES 22 AND 23

Application properties of graft polymers 2 and 7 mixed with starch (67% of hydroxypropyl potato starch mixed with 33% of graft polymer or, as comparison, with 33% of bone glue) on cotton. The size level on the yarns was 15%.

| | | Sizing effect | |
|---|---|---|---|
| Example | Sizing agent | Pilling | Pseudo warp yarn breakage |
| 22 | Graft polymer 2 | 283 | 602 |
| 23 | Graft polymer 7 | 382 | 680 |
| | Bone glue (comparison) | 173 | 377 |

As can be seen from Examples 1 to 23, the free radical grafting with ethylenically unsaturated monomers modifies proteins in such a way as to improve their textile size properties appreciably.

We claim:

1. A method for sizing staple fiber and filament yarns comprising:

contacting said staple fiber and filament yarns with an aqueous liquor of a sizing agent, wherein said sizing agent is a grafted protein obtained by free radical polymerization of (a) a monoethylenically unsaturated monomer in the presence of (b) a protein in water in a weight ratio (a):(b) of (0.5–90):(99.5–10).

2. The method according to claim 1, wherein said grafted protein is obtained by free radical polymerization of (a) a monomer selected from the group consisting of monoethylenically unsaturated $C_3$–$C_5$-carboxylic acids, esters, amides, and nitrile, and vinyl esters of saturated $C_2$–$C_4$-carboxylic acids, styrene and mixtures thereof in the presence of (b) casein, gelatin, bone glue or a protein from soybeans, cereals, corn or peas.

3. The method according to claim 1, wherein said grafted protein is obtained by free radical polymerization of (a) acrylic acid, methacrylic acid, an ester of acrylic or methacrylic acid with a monohydric $C_1$–$C_8$-alcohol, an N-($C_1$–$C_4$-alkoxymethyl)-acrylamide or an N-($C_1$–$C_4$-alkoxymethyl)-methyacrylamide in water in the presence of (b) casein.

* * * * *